US009482067B2

(12) United States Patent
Dewars et al.

(10) Patent No.: US 9,482,067 B2
(45) Date of Patent: Nov. 1, 2016

(54) HYDRAULIC ANCHOR FOR DOWNHOLE PACKER

(71) Applicant: TAM International, Inc., Houston, TX (US)

(72) Inventors: Colin Dewars, Aberdeen (GB); Philip Scott, Aberdeen (GB); Steven Scott, Aberdeen (GB)

(73) Assignee: TAM INTERNATIONAL, INC., Houston, TX (US)

( * ) Notice: Subject to any disclaimer, the term of this patent is extended or adjusted under 35 U.S.C. 154(b) by 329 days.

(21) Appl. No.: 14/311,260

(22) Filed: Jun. 21, 2014

(65) Prior Publication Data

US 2014/0374119 A1 Dec. 25, 2014

Related U.S. Application Data

(60) Provisional application No. 61/926,571, filed on Jan. 13, 2014, provisional application No. 61/837,876, filed on Jun. 21, 2013.

(51) Int. Cl.

| | |
|---|---|
| ***E21B 33/00*** | (2006.01) |
| ***E21B 33/124*** | (2006.01) |
| ***E21B 33/1295*** | (2006.01) |

(52) U.S. Cl.

CPC ..... *E21B 33/00* (2013.01); *E21B 33/1243* (2013.01); *E21B 33/1295* (2013.01)

(58) Field of Classification Search

USPC ..... 166/373, 120

See application file for complete search history.

(56) References Cited

U.S. PATENT DOCUMENTS

| | | | | |
|---|---|---|---|---|
| 2,951,539 | A | 9/1960 | Malone et al. | |
| 3,460,625 | A | 8/1969 | Hart et al. | |
| 3,868,995 | A | 3/1975 | Crowe | |
| 8,061,447 | B2 * | 11/2011 | Krueger, V | E21B 4/18 166/212 |
| 9,228,403 | B1 * | 1/2016 | Bloom | E21B 4/18 |
| 2008/0308318 | A1 * | 12/2008 | Moore | E21B 4/04 175/51 |
| 2009/0101362 | A1 | 4/2009 | Loughlin | |
| 2011/0067855 | A1 | 3/2011 | Van De Vliert | |
| 2013/0062073 | A1 | 3/2013 | Landsiedel | |

FOREIGN PATENT DOCUMENTS

WO 2011060493 A1 5/2011

OTHER PUBLICATIONS

International Search Report and Written Opinion Issued in PCT Patent Application No. PCT/US2014/043534 dated Feb. 18, 2014 (10 pages).

* cited by examiner

*Primary Examiner* — Taras P Bemko
(74) *Attorney, Agent, or Firm* — Adolph Locklar

(57) ABSTRACT

A hydraulic anchor is coupled to a packer subassembly of a tool string. The hydraulic anchor, when actuated by fluid pressure, engages the surrounding wellbore, holding the tool string in place within the wellbore. A packer may then be actuated, held in position within the wellbore by the hydraulic anchor. In some embodiments, an inflatable packer may be held in the desired location by the hydraulic anchor. In some embodiments, a straddle packer assembly may be held in place by the hydraulic anchor. In some embodiments, a swellable packer may be held in place during the swelling process by the hydraulic anchor.

21 Claims, 16 Drawing Sheets

HYDRAULIC ANCHOR FOR DOWNHOLE PACKER

CROSS-REFERENCE TO RELATED APPLICATIONS

This application is a non-provisional application which claims priority from U.S. provisional application No. 61/837,876, filed Jun. 21, 2013, the entirety of which is hereby incorporated by reference; and from U.S. provisional application No. 61/926,571, filed Jan. 13, 2014, the entirety of which is hereby incorporated by reference.

TECHNICAL FIELD/FIELD OF THE DISCLOSURE

The present disclosure relates generally to downhole tools for positioning a tool string, and more specifically to a downhole tool for maintaining the position of a tool string within a wellbore.

BACKGROUND OF THE DISCLOSURE

In drilling an oil well, a variety of operations may be carried out on a wellbore. For certain operations, the accurate positioning of a tool within the well may be critical. As an example, operations such as acidizing, fracturing, flow testing, washing perforations or pressure testing may specifically target a certain section of wellbore. In these operations, the targeted section of wellbore may be isolated from the wellbore areas both above and below. For these operations, a "straddle packer" assembly may be utilized.

A straddle packer may include inflatable packers positioned on either side of the wellbore section to be treated. Connecting the packers is a tubular member which may include at least one selectively openable port. In order to effectively treat the section of wellbore, positioning of the straddle packer is very important, as the targeted section of wellbore must be between the upper and lower packers so that the ported tubular may act thereon. While the packers are inflated, until contact is made with the wellbore, the straddle packer assembly may move undesirably within the wellbore. Additionally, to ensure the straddle packer assembly remains in position, a portion of the contact area between each packer and the wellbore is typically made up of metal slats. The slats, though effective in preventing movement of the packer, are not as effective in sealing against the wellbore as the flexible outer bladder of the packer.

SUMMARY

The present disclosure provides for a downhole tool for use within a wellbore. The downhole tool may include a hydraulic anchor. The hydraulic anchor may include a tool body. The tool body may include a generally cylindrical mandrel, the mandrel having an interior. The tool body may also include a coupler positioned to allow the tool body to couple to a tubular member. The hydraulic anchor may also include a stroking sleeve. The stroking sleeve may be generally tubular, and may be positioned to slide along the mandrel of the tool body. The hydraulic anchor may also include an actuation cylinder, the actuation cylinder formed between the stroking sleeve and the tool body. The actuation cylinder may be fluidly coupled to the interior of the mandrel. The hydraulic anchor may also include an extendible arm. The extendible arm may include a grip plate, a first extension linkage, and a second extension linkage. The first extension linkage may be pivotably coupled between the tool body and the grip plate. The second extension linkage may be pivotably coupled between the grip plate and the stroking sleeve. The downhole tool may also include an inflatable packer. The inflatable packer may include a packer mandrel, the packer mandrel having an interior. The inflatable packer may also include a packer bladder, the packer bladder being generally tubular in shape and positioned about the packer mandrel. The inflatable packer may also include a packer inflation port, the packer inflation port formed in the packer mandrel and positioned to couple the interior of the packer mandrel with the annular space between the packer mandrel and the packer bladder.

The present disclosure also provides for a downhole tool for use within a wellbore. The downhole tool may include a hydraulic anchor. The hydraulic anchor may include a tool body, the tool body including a generally cylindrical mandrel having an interior. The tool body may include a coupler positioned to allow the tool body to couple to a tubular member. The hydraulic anchor may also include a stroking sleeve, the stroking sleeve being generally tubular and positioned to slide along the mandrel of the tool body. The hydraulic anchor may also include an actuation cylinder formed between the stroking sleeve and the tool body. The actuation cylinder may be fluidly coupled to the interior of the mandrel. The hydraulic anchor may also include an extendible arm. The extendible arm may include a grip plate, a first extension linkage, and a second extension linkage. The first extension linkage may be pivotably coupled between the tool body and the grip plate. The second extension linkage may be pivotably coupled between the grip plate and the stroking sleeve. The downhole tool may also include a swellable packer. The swellable packer may include a packer mandrel, the packer mandrel having an interior. The packer mandrel may be coupled to the tool body. The swellable packer may also include an elastomeric swellable body, the elastomeric swellable body being generally tubular in shape and positioned about the packer mandrel.

The present disclosure also provides for a method. The method may include positioning a tool string within a wellbore. The tool string may include a hydraulic anchor. The hydraulic anchor may include a tool body, the tool body including a generally cylindrical mandrel having an interior. The tool body may include a coupler positioned to allow the tool body to couple to a tubular member. The hydraulic anchor may also include a stroking sleeve being generally tubular and positioned to slide along the mandrel of the tool body. The hydraulic anchor may also include an actuation cylinder formed between the stroking sleeve and the tool body. The actuation cylinder may be fluidly coupled to the interior of the mandrel. The hydraulic anchor may also include an extendible arm. The extendible arm may include a grip plate, a first extension linkage, and a second extension linkage. The first extension linkage may be pivotably coupled between the tool body and the grip plate. The second extension linkage may be pivotably coupled between the grip plate and the stroking sleeve. The tool string may also include a swellable packer. The swellable packer may include a packer mandrel having an interior. The packer mandrel may be coupled to the tool body. The swellable packer may include an elastomeric swellable body, the elastomeric swellable body being generally tubular in shape and positioned about the packer mandrel. The method may further include applying fluid pressure to the actuation cylinder. The method may further include extending the extendible arm, the extendible arm contacting the surrounding wellbore. The method may further include exposing the elastomeric swellable body to a swelling fluid, the elastomeric swellable body increasing in volume to form a seal between the packer mandrel and the wellbore.

The present disclosure also provides for a method. The method may include positioning a tool string within a wellbore. The tool string may include a hydraulic anchor. The hydraulic anchor may include a tool body, the tool body including a generally cylindrical mandrel having an interior. The tool body may include a coupler positioned to allow the tool body to couple to a tubular member. The hydraulic anchor may also include a stroking sleeve being generally tubular and positioned to slide along the mandrel of the tool body. The hydraulic anchor may also include an actuation cylinder formed between the stroking sleeve and the tool body. The actuation cylinder may be fluidly coupled to the interior of the mandrel. The hydraulic anchor may also include an extendible arm. The extendible arm may include a grip plate, a first extension linkage, and a second extension linkage. The first extension linkage may be pivotably coupled between the tool body and the grip plate. The second extension linkage may be pivotably coupled between the grip plate and the stroking sleeve. The tool string may also include an inflatable packer. The inflatable packer may include a packer mandrel, the packer mandrel having an interior. The inflatable packer may include a packer bladder, the packer bladder being generally tubular in shape and positioned about the packer mandrel. The inflatable packer may include a packer inflation port formed in the packer mandrel and positioned to couple the interior of the packer mandrel with the annular space between the packer mandrel and the packer bladder. The method may also include applying fluid pressure to the actuation cylinder, and extending the extendible arm, the extendible arm contacting the surrounding wellbore. The method may also include applying fluid pressure to the packer inflation port, inflating the inflatable packer.

The present disclosure also provides for a downhole tool on a tool string having a tool string bore positionable in a wellbore having a wellbore axis. The downhole tool may include a first packer sub coupled to the tool string, the packer sub having a first inflatable element and a first packer inflation port. The downhole tool may also include a valve sub coupled to the tool string. The valve sub may include a valve sub housing, the valve sub housing being generally tubular having at least one packer supply port in fluid communication with the packer inflation port. The valve sub may further include a control tube, the control tube being generally tubular and aligned with the valve sub housing and having an upper and lower end, the upper end coupled to the tool string, and the lower end positioned within the bore of the valve sub housing. The control tube may have a bore and at least one aperture through its side wall. The control tube may have an open position in which the aperture provides fluid communication between the bore of the control tube and the packer supply port and a closed position in which the apertures are covered by the inner wall of the valve sub housing and the bore of the control tube. The control tube bore may be in fluid communication with the tool string bore. The valve sub may further include a shift sleeve coupled to the lower end of the control tube having a hole adapted to accept an axle pin. The valve sub may further include a rotatable ball adapted to rotate about the axle pin. The rotatable ball may have at least one flow path through its body. The rotatable ball may have an open position and a closed position selected by the upward or downward movement of the tool string. The open and closed positions of the rotatable ball may be in opposition to the open and closed position of the control tube, thereby allowing or preventing fluid flow through the at least one flow path from the tool string bore and the bore of the control tube. The rotatable ball may have a rotation pin extending from its outer surface. The valve sub may include a rotation pin sleeve coupled to the rotation pin and adapted to rotate the ball from the closed position to the open position in response to a movement of the ball toward or away from the rotation pin sleeve. The downhole tool may also include a hydraulic anchor. The hydraulic anchor may include a tool body, the tool body including a generally cylindrical mandrel having an interior. The tool body may include a coupler positioned to allow the tool body to couple to a tubular member. The hydraulic anchor may also include a stroking sleeve being generally tubular and positioned to slide along the mandrel of the tool body. The hydraulic anchor may also include an actuation cylinder formed between the stroking sleeve and the tool body. The actuation cylinder may be fluidly coupled to the interior of the mandrel. The hydraulic anchor may also include an extendible arm. The extendible arm may include a grip plate, a first extension linkage, and a second extension linkage. The first extension linkage may be pivotably coupled between the tool body and the grip plate. The second extension linkage may be pivotably coupled between the grip plate and the stroking sleeve.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
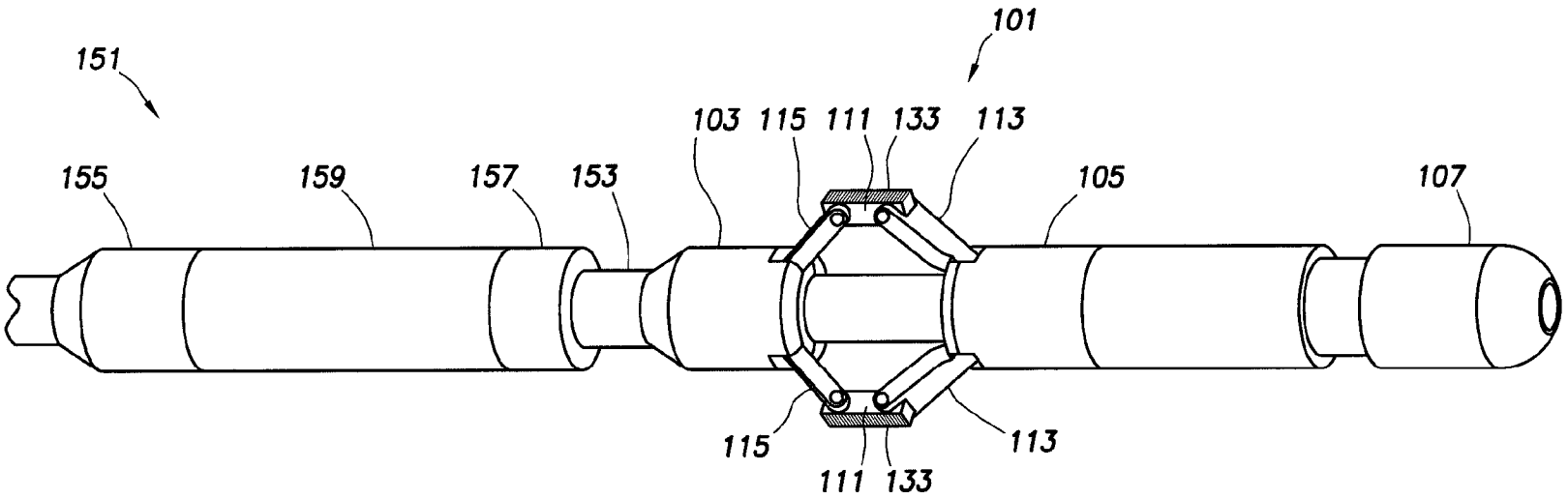
FIG. 1 depicts a perspective view of a hydraulic anchor consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, hydraulic anchor 101 may be coupled to inflatable packer assembly 151. Inflatable packer assembly 151 may be a part of, for example and without limitation, a single packer or straddle packer assembly. Hydraulic anchor 101 may include tool body 103, stroking sleeve 105 and one or more extendible arms 109. Extendible arms 109 may include grip plate 111 and extension linkages 113, 115. Extension linkages 113, 115 may be coupled to stroking sleeve 105 and tool body 103 respectively to move grip plate 111 radially inward or outward in response to a movement of stroking sleeve 105 towards or away from tool body 103. In some embodiments, tool body 103 is pivotably coupled to extension linkage 115 and stroking sleeve 105 is likewise pivotably coupled to extension linkage 113. In some embodiments, extension linkages 113, 115 are likewise pivotably coupled to grip plate 111.

Inflatable packer assembly 151, as understood in the art, may include tubular member 153, upper and lower housings 155, 157, and packer bladder 159. In some embodiments, inflatable packer assembly 151 relies on hydraulic anchor 101 to prevent movement within the wellbore and thus may include no external slats.

Figure 2:
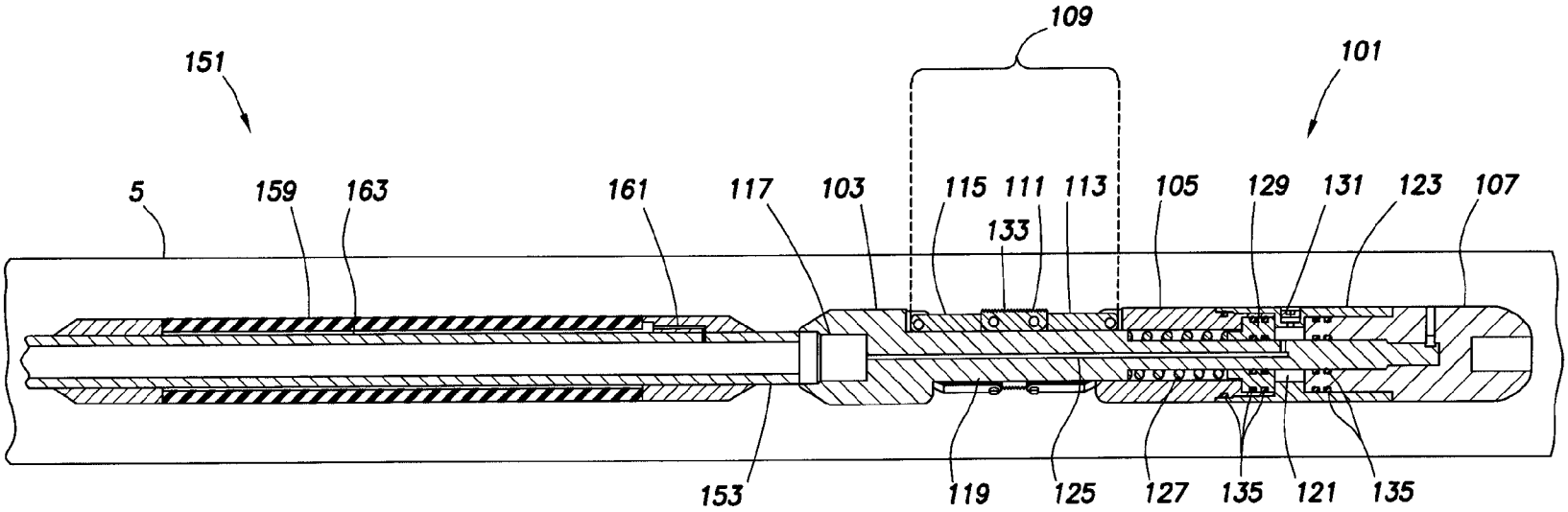
FIG. 2 depicts a cross section view of the hydraulic anchor of FIG. 1 in the run-in position.
Figure 3:
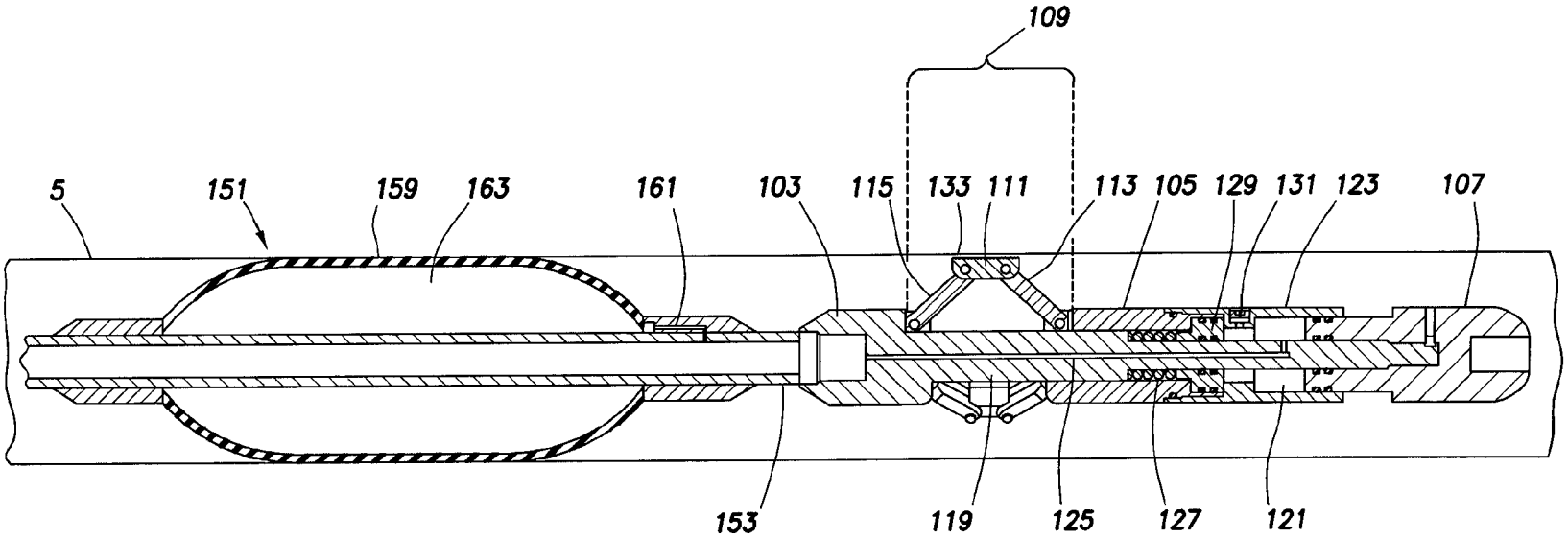
FIG. 3 depicts a cross section view of the hydraulic anchor of FIG. 1 in the set position.

As depicted in FIGS. 2, 3, tool body 103 may include coupler 117 positioned to allow hydraulic anchor 101 to connect to tubular member 153. Coupler 117 may be a threaded box connector as understood in the art. One having ordinary skill in the art with the benefit of this disclosure will understand that coupler 117 may be any sort of connector suitable for coupling hydraulic anchor 101 to tubular member 153. Furthermore, one having ordinary skill in the art with the benefit of this disclosure will understand that tubular member 153 may include any tubular member for use in a wellbore, including, without limitation, a tool such as packer assembly 151, or a section of drill pipe, a perforating gun, etc.

In some embodiments, tool body 103 may further include mandrel 119. Mandrel 119 may be generally cylindrical so that stroking sleeve 105 may slide along mandrel 119 in response to hydraulic pressure introduced into actuation cylinder 121. In some embodiments, actuation cylinder 121 may be formed in a space between mandrel 119 and lower extension 123 of stroking sleeve 105. In some embodiments, as depicted in FIGS. 1, 2, and 3, lower extension 123 may be formed as a separate piece from stroking sleeve 105 and may be coupled thereto by, for example, a threaded connection. In some embodiments, tool body 103 may include lower sub 107 coupled to mandrel 119. In some embodiments, lower sub 107 may form a wall of actuation cylinder 121. Mandrel 119 may couple to lower sub 107 by, for example, a threaded connection. Lower sub 107 may have a rounded profile to, for example, help guide hydraulic anchor 101 through the wellbore as it is inserted.

Fluid may be supplied to actuation cylinder 121 via actuation port 125. In some embodiments, actuation port 125 may be formed through the interior of mandrel 119. Actuation port 125 may extend between the interior of tubular member 153 coupled to coupler 117 and actuation cylinder 121. As fluid pressure within actuation cylinder 121 increases, for example, as a result of an increase in fluid pressure within a tubular member 153, stroking sleeve 105 moves from the run-in position depicted in FIG. 2 to the set position as depicted in FIG. 3. As stroking sleeve 105 moves along mandrel 119, extendible arm 109 extends outward from mandrel 119. As the length between tool body 103 and stroking sleeve 105 decreases, extension linkages 113, 115 may cause grip plate 111 to move outward until grip plate 111 contacts the surrounding wellbore 5 thus holding hydraulic anchor 101 in place within wellbore 5. Further pressure increase may, for example, exert additional force between grip plate 111 and wellbore 5, thus, for example, increasing the strength at which hydraulic anchor 101 is held in place within the wellbore.

Also in response to the increase in fluid pressure, fluid flows through packer actuation port 161 from the interior of tubular member 153. Packer actuation port 161 may be coupled to the interior 163 of packer bladder 159. As fluid pressure increases within the interior 163 of packer bladder 159, packer bladder 159 expands from the run-in position depicted in FIG. 2 to the set position as depicted in FIG. 3, sealing against wellbore 5. In some embodiments, packer actuation port 161 may further include a valve apparatus positioned between the interior of tubular member 153 and the interior 163 of packer bladder 159. In some embodiments, the valve may prevent or restrict the inflation of packer bladder 159 until, for example, hydraulic anchor 101 has fully engaged wellbore 5.

When it is desired to move hydraulic anchor 101, pressure is bled from the interior of tubular member 153. Packer bladder 159 thus deflates into the interior of tubular member 153. Likewise, pressure is bled from actuation cylinder 121. In some embodiments, spring 127 may be positioned to return stroking sleeve 105 to the run-in position. Spring 127 may be retained by piston 129 coupled to stroking sleeve 105. Spring 127 may, for example, assist stroking sleeve 105 to move back along mandrel 119. As the distance between tool body 103 and stroking sleeve 105 increases, extension linkages 113, 115 may cause grip plate 111 to move inward, away from the wall of the surrounding wellbore, thus releasing hydraulic anchor 101 from the wellbore.

In some embodiments, rupture disc 131 may be positioned in fluid communication with actuation cylinder 121 and the surrounding wellbore. Rupture disc 131 is positioned to release pressure within actuation cylinder 121 in the event that the differential pressure therebetween reaches a predetermined threshold value. The threshold value may be determined to, for example, prevent damage to either hydraulic anchor 101 or the surrounding wellbore. Additionally, if fluid becomes trapped in actuation cylinder 121 by, for example, a blockage in actuation port 125, a sufficiently strong pull on hydraulic anchor 101 from the attached tubular member may cause rupture disc 131 to rupture and release the pressure, allowing extension arms 109 of hydraulic anchor 101 to retract. As hydraulic anchor 101 is pulled upward within the wellbore, the resultant force of the wellbore may cause a downward movement of grip plate 111, which translates into a movement of stroking sleeve 105. This movement of stroking sleeve 105 may decrease the volume of actuation cylinder 121, thus causing an increase in pressure within actuation cylinder 121. Sufficient increase in pressure may thus cause rupture disc 131 to fail.

In some embodiments, as depicted in FIGS. 2, 3, rupture disc 131 may be positioned on lower extension 123. In other embodiments, one having ordinary skill in the art with the benefit of this disclosure will understand that rupture disc 131 may be positioned at any location and on any component in fluid communication with actuation cylinder 121 positioned to release pressure from within actuation cylinder 121 into the surrounding wellbore.

In some embodiments, grip plate 111 may include a surface texture to, for example, increase resistance to the slipping of grip plate 111 along the surrounding wellbore. As depicted in FIGS. 1-3, the surface texture may include ridges 133. One having ordinary skill in the art with the benefit of this disclosure will understand that any surface texture may be substituted for ridges 133 without deviating from the scope of this disclosure. For example, the surface texture may include, without limitation, ridges, spikes, knurling, teeth, or any combination thereof.

In some embodiments, one or more seals 135 may be positioned to, for example, retain fluid pressure within actuation cylinder 121. Seals 135 may be positioned between lower sub 107 and mandrel 119, mandrel 119 and stroking sleeve 105 (or any related component including spring retention nut 129 as shown), between components of stroking sleeve 105 (including between stroking sleeve 105, lower extension 123, or spring retention nut 129, and/or between lower extension 123 and lower sub 107).

In some embodiments, hydraulic anchor 101 may be designed such that hydraulic anchor 101 engages wellbore 5 before the inflatable packers begin to inflate. Likewise, hydraulic anchor 101 may be designed such that the inflatable packers fully deflate before hydraulic anchor 101 releases. Such a configuration may, for example, prevent damage to either wellbore 5 or inflatable packer 151 from movement of a partially inflated packer within the wellbore.

Figure 15:
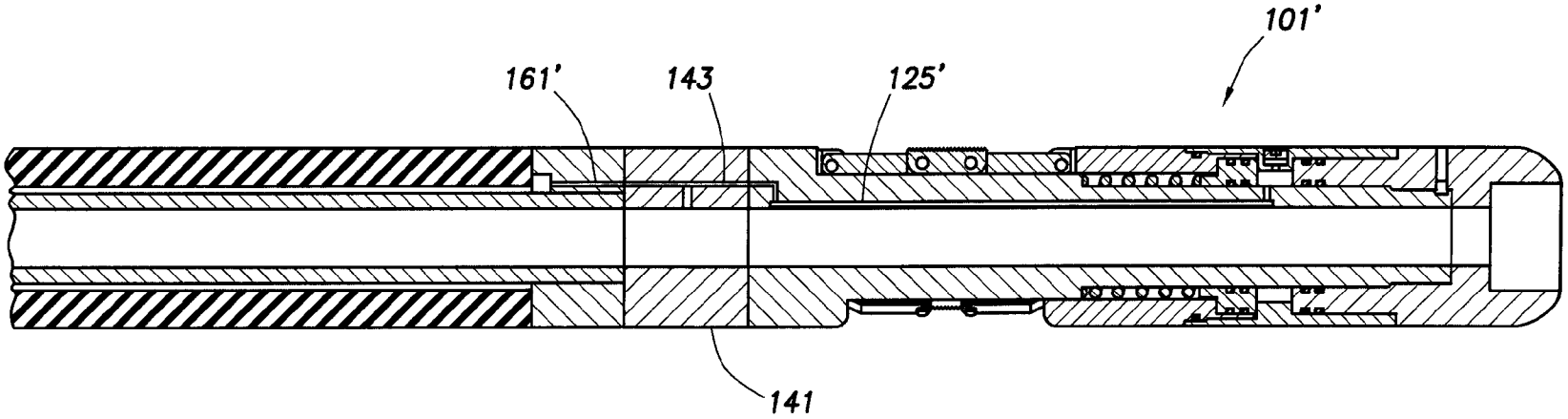
FIG. 15 is a partial cross section of a hydraulic anchor consistent with embodiments of the present disclosure.

Although mandrel 119 is depicted as a solid member having actuation port 125 formed therein, one having ordinary skill in the art with the benefit of this disclosure will understand that mandrel 119 may instead be, for example, a tubular member. Actuation port 125 may, in such an embodiment, be formed within the wall of mandrel 119 or as an external control line. For example, FIG. 15 depicts a mechanical anchor 101' having actuation port 125' formed in the wall of mandrel 119'. Actuation port 125' is coupled to 3 way sub 141. 3 way sub 141 may include port 143 which couples between the interior of 3 way sub 141 and both actuation port 125 of mechanical anchor 101' and packer actuation port 161'.

Actuation port 125 may, in some embodiments, be coupled to a valve assembly positioned in packer actuation port 161. Furthermore, although not depicted, mandrel 119 may include a second coupler positioned on the end opposite coupler 117 positioned to receive an additional tubular member, allowing the tool string to extend below hydraulic anchor 101.

FIGS. 4-11 depict a straddle packer assembly 10 including hydraulic anchor 701 being actuated via control hose 725. Straddle packer assembly 10 may include string connection sub 20, valve sub 30, upper packer sub 40, fracing sub 50, lower packer sub 60, and nose sub 70.

Figure 4:
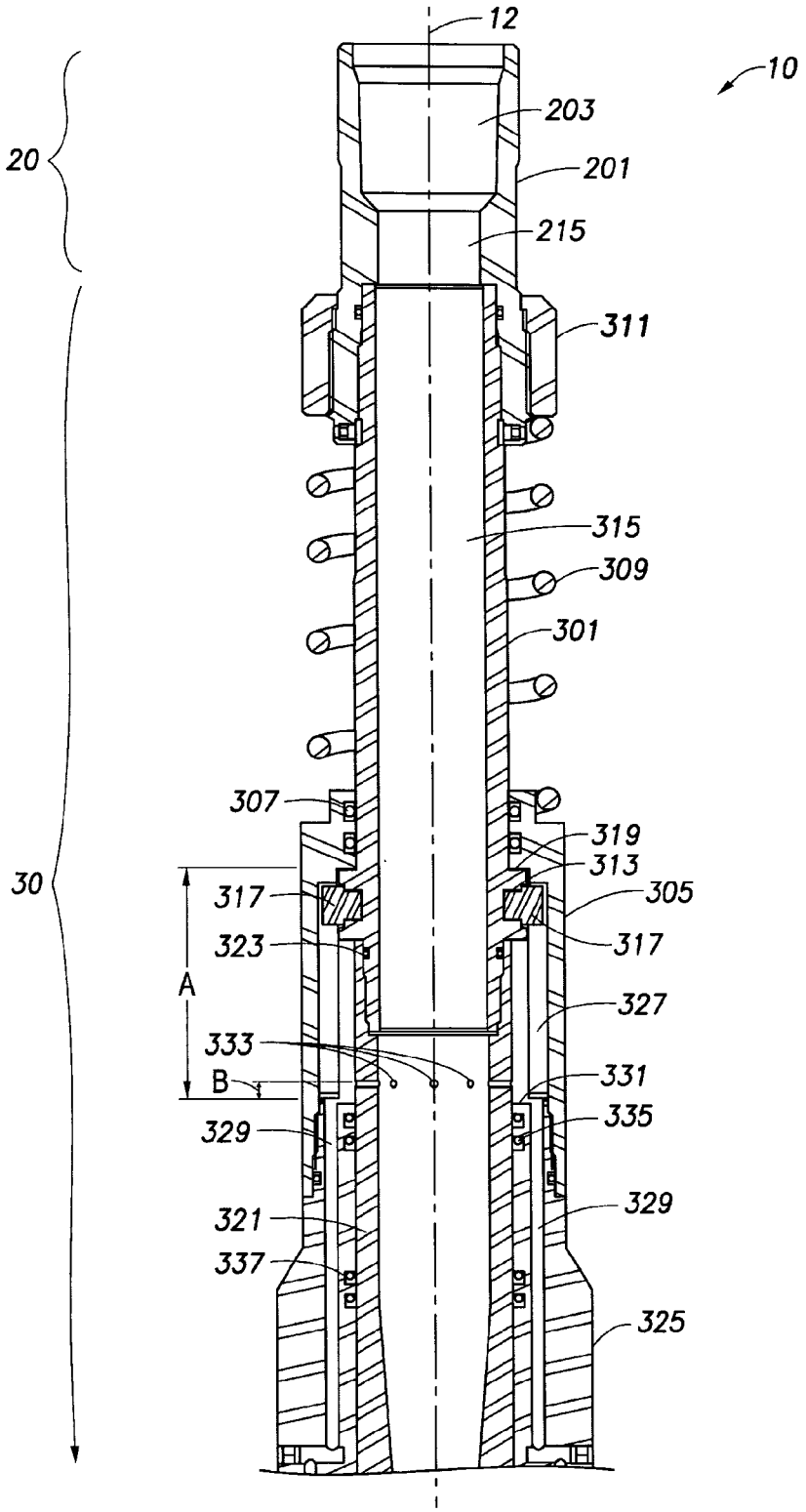
FIG. 4 is a partial cross section of a straddle packer assembly consistent with embodiments of the present disclosure.

String connection sub 20, as depicted in FIG. 4, may include upstream connection housing 201. Upstream connection housing 201 is generally cylindrical and may include upstream receptacle 203 configured to couple straddle packer assembly 10 to the rest of a work string (not shown) for insertion down a borehole. Upstream receptacle 203 may be a threaded joint or any other coupling suitable for downhole string connections. Upstream connection housing 201 is configured to couple to an upper end of control tube 301 of valve sub 30 by, for example, a threaded connection, and provide a sealed connection between string connection sub bore 215 and valve sub bore 315. Seal 303 as illustrated may assist in this seal.

Control tube 301, as illustrated, is a generally straight-walled cylindrical tube which extends axially downward from string connection sub 20. The lower end of control tube 301 fits into the bore of upper control housing 305. The bore of upper control housing 305 is generally cylindrical, and at its upper end has a diameter selected to allow a clearance or sliding fit with the outer wall of control tube 301. Outer wall of control tube 301 is fluidly sealed to the interior of upper control housing 305 by at least one seal 307, and is permitted to slide into and out of upper control housing 305 by upward or downward loading of the work string. In some embodiments, spring 309 may be included and configured to apply compressive force between piston 311 and the upper wall of upper control housing 305. Piston 311 is coupled to the outer wall of upstream connection housing 201 by, for example, a threaded connection. Spring 309 is illustrated as a coil spring axially disposed around control tube 301.

Control tube 301 may include, proximal to its lower end, at least one locking feature for preventing removal from upper control housing 305. Likewise, upper control housing 305 at its upper end may include a matching locking feature. For example, FIG. 4 illustrates control tube 301 having at least one flanged groove 313 configured to accept at least one J-pin 317. As illustrated, as control tube 301 is pulled upward from any upward work string loading or force from spring 309, flanged groove 313 abuts against at least one upper interior flange 319 of upper control housing 305. J pin 317 is positioned within an internal groove that is part of upper control housing 305. J pin 317 allows any torque applied to the work string to be transmitted through the upper control housing 305 and subsequently through the entire valve sub 30. Upper interior flange 319 of upper control housing 305 is formed by an increase in diameter of the inner wall of upper control housing 305. One of ordinary skill in the art will understand that this is only an exemplary configuration for preventing removal of control tube 301 from upper control housing 305, and other technically equivalent locking feature may be employed without deviating from the scope of this disclosure.

Control tube 301 is coupled at its lower end to control tube extension 321 forming a fluidly sealed connection between the interior bore of control tube 301 and the interior bore of control tube extension 321, here depicted as including seal 323. Control tube extension 321 is a generally cylindrical, straight-walled tube extending downward along central axis 12, the bore of which fluidly connecting to and forming a continuation of valve sub bore 315.

Upper control housing 305 is coupled at its lower end to the upper end of lower control housing 325 forming a fluidly sealed connection between annular space 327 and at least one packer inflation port 329 formed in the body of lower control housing 325. Annular space 327 is defined as the cavity formed between the outer surface of control tube 301 and/or control tube extension 321 and the inner surface of upper control housing 305. Packer inflation port 329 continues through the rest of valve sub 30 to packer sub 40. Lower control housing 325 is a generally cylindrical tube having a smaller inner diameter than the inner diameter of the lower end of upper control housing 305, forming a lower interior flange 331. Lower interior flange 331 is positioned as a means to prevent over-insertion of control tube 301. When actuated, control tube 301 is forced downward into an "actuated position" by downward work string loading. Flanged groove 313 and J-pin 317 abut against upper surface 331, preventing any further movement. One of ordinary skill in the art will understand that this is only an exemplary configuration for preventing overinsertion, and other technically equivalent features may be employed without deviating from the scope of this disclosure. In this example, the axial distance between upper interior flange 319 and lower interior flange 331 defines stroke length A, the distance control tube 301 is allowed to traverse between the run-in position and the actuated position.

Referring to FIG. 4, the inner diameter of lower control housing 325 is selected to form a close clearance fit with outer wall of control tube extension 321. Control tube extension 321 is able to traverse axially within lower control housing 325 as control tube 301 is moved.

Proximal to the upper end of control tube extension 321, a series of apertures 333 are positioned through the wall of control tube extension 321. Apertures 333 connect the bore of control tube extension 321 to the surrounding area. When control tube extension 321 is in the run-in position, as depicted in FIG. 4, apertures 333 form a fluid connection between the bore of control tube 321 and annular space 327, thereby allowing fluid a continuous connection between the bore of the work string and packer inflation port 329. When control tube extension 321 is in the actuated position, apertures 333 are sealed off from annular space 327 by the inner diameter of lower control housing 325. In this example, at least one seal 335 is positioned axially above the axial location of the apertures 333 in the actuated position, and at least one seal 337 is positioned axially below the axial location of the apertures 333 in the actuated position. seals 335, 337 may be provided to assist with maintaining a seal throughout the sliding traverse of control tube extension 321. The positioning of apertures 333 determines the cut-off characteristics of the connection between the bore of control tube 321 and annular space 327. As depicted, apertures 333 are circular and disposed circumferentially about control tube extension 321. One of ordinary skill in the art would understand that the number, shape, and distribution of apertures may be varied without deviating from the scope of this disclosure.

The axial distance between lower interior flange 331 and topmost extent of apertures 333 defines a packer cut-off length B, which is the distance control tube extension 321 must traverse axially downward before the fluid connection between the bore and annular space 327 is severed.

Figure 5:
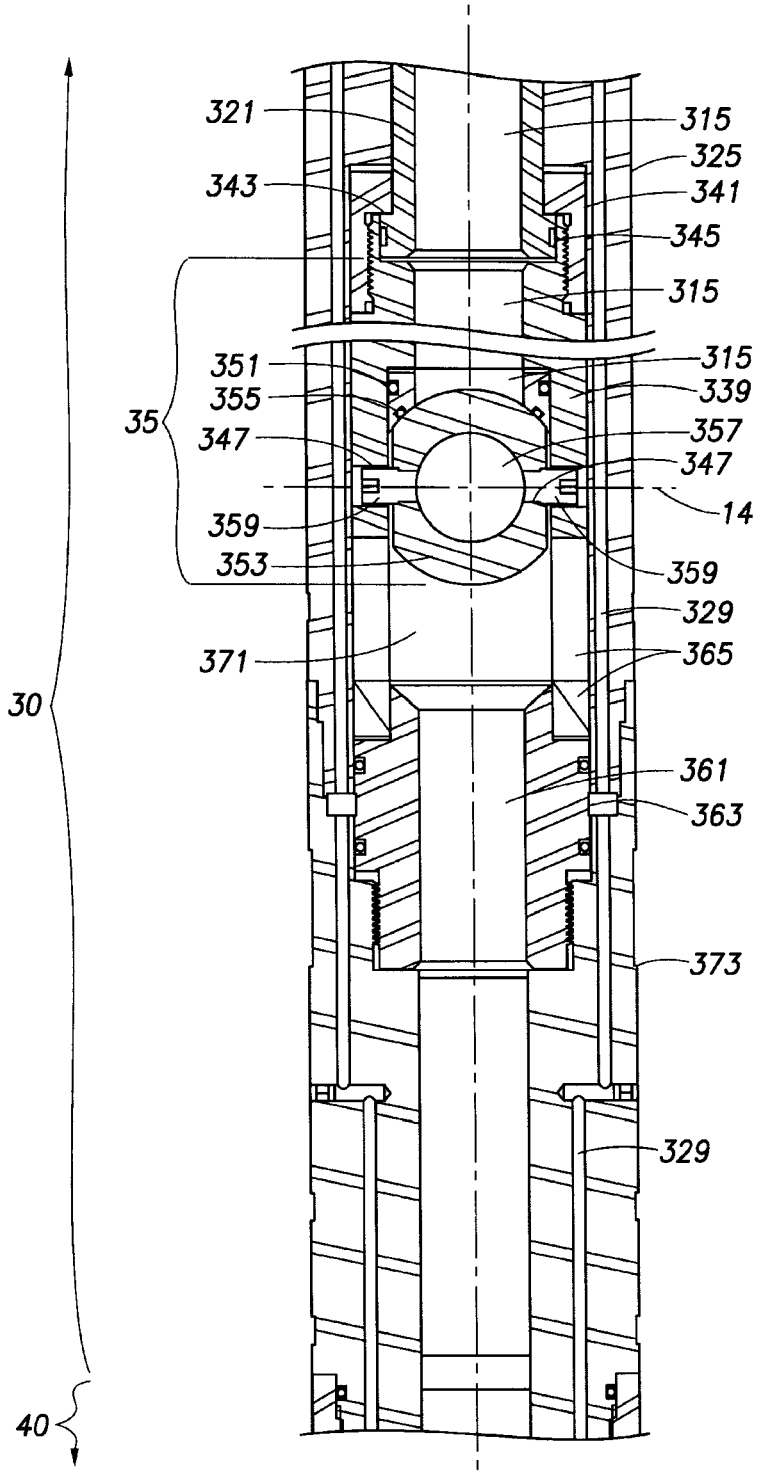
FIG. 5 is a continuation of the partial cross section of FIG. 4.
Figure 6:
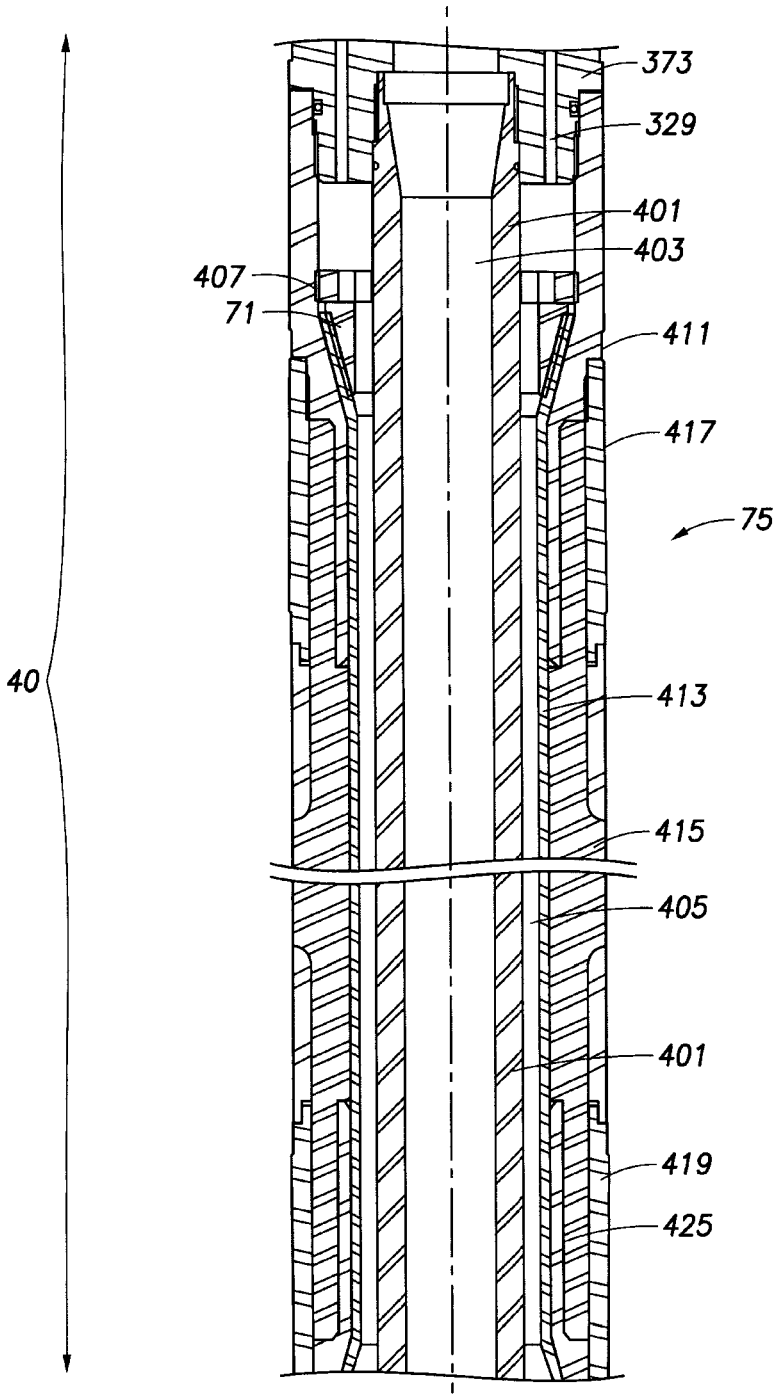
FIG. 6 is a continuation of the partial cross section of FIG. 5.

Referring now to FIG. 5, control tube extension 321 continues axially downward within the bore of lower control housing 325. The lower end of control tube extension 321 is coupled to the upper end of shift sleeve 339 by retainer nut 341. In this example, retainer nut 341 is threadedly connected to the upper outer wall of shift sleeve 339, and secures over outward flange 343 of the lower outer wall of control tube extension 321. The upper end of shift sleeve 339 fits annularly around the lower end of control tube extension 321. Debris barrier 345, located in the annular interface between shift sleeve 339 and control tube extension 321, contains at least one fluid path allowing fluid to escape the bore of shift sleeve 339 and control tube extension 321.

Shift sleeve 339, may be a generally cylindrical tube extending axially downward, the bore of which fluidly connecting to and forming a continuation of valve sub bore 315. The lower end of shift sleeve 339 may include valve axle holes 347 along valve axle axis 14. Valve axle axis 14 is coincident and orthogonal to central axis 12. A portion of one side of the lower end of shift sleeve 339 is "cut away" along a plane parallel to central axis 12 and a plane parallel to valve axle axis 14. At the cut away portion, shift sleeve 339 is coupled to ball seat 349. Ball seat 349 is a generally cylindrical tube which fits within an inset of shift sleeve 339, the bore of which fluidly connecting to and forming a continuation of valve sub bore 315. One or more seals 351 may be used to ensure a fluid seal between ball seat 349 and shift sleeve 339.

The lower end of ball seat 349 is adapted to closely fit against the surface of rotatable ball 353. In at least one embodiment, the lower end of ball seat 349 is coupled to shift sleeve 339 so that ball seat 349 can move axially relative to rotatable ball 353 and shift sleeve 339 so that ball seat 349 forms sealing contact when fluid is pumped into the valve sub bore 315. One or more seals 355 may be used to ensure there is a sufficient seal between ball seat 349 and rotatable ball 353 to reliably divert fluid to inflate the packer elements with a prescribed volumetric flow rate. Rotatable ball 353 is generally spherical with valve bore 357 through its center. Rotatable ball 353 is rotatably coupled to shift sleeve 339 by valve axle pins 359, and may freely rotate about valve axle axis 14. Rotatable ball 353 is positioned to rotate approximately 90° when transitioned from its run-in position, shown in FIG. 5, to its actuated position. In the run-in position, valve bore 357 is oriented to not form a continuous fluid pathway with valve sub bore 315. In the actuated position, control tube extension 321, retainer nut 341, shift sleeve 339, ball seat 349, and rotatable ball 353 have translated downward a distance of stroke-length A in response to downward force of control tube 301. Rotatable ball 353 has also rotated approximately 90° about valve axle axis 14, thereby aligning valve bore 357 with central axis 12 and allowing fluid, communication between valve sub bore 315 and valve output bore 361.

Rotatable ball 353 in the actuated position abuts the upper edge of pressure tube 363 and forms a continuous fluid connection between valve sub bore 315 and valve output bore 361. The top surface of pressure tube 363 forms a lower valve seat which is adapted to closely fit the surface of rotatable ball 353.

Figure 13A:
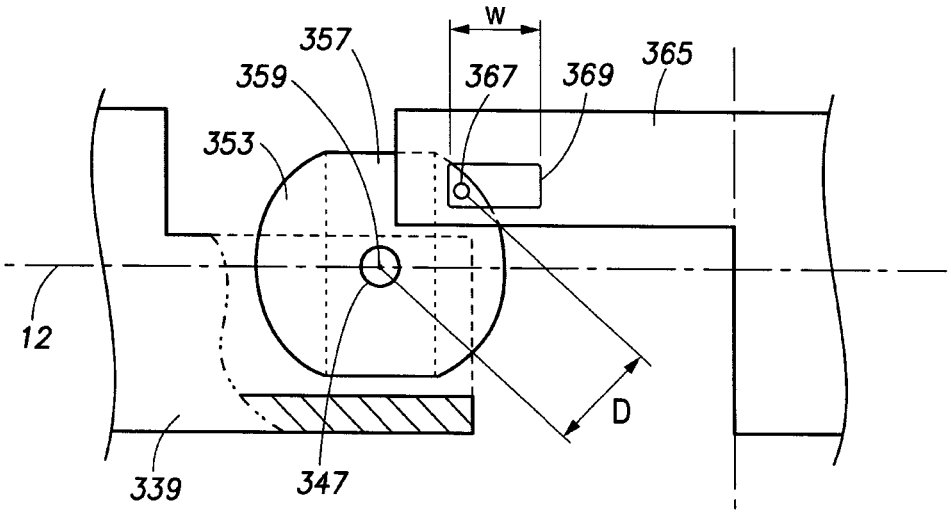
FIG. 13A is a partial cross section of components of the straddle packer assembly of FIG. 4 in a "run-in configuration" consistent with at least one embodiment of the present disclosure.
Figure 13B:
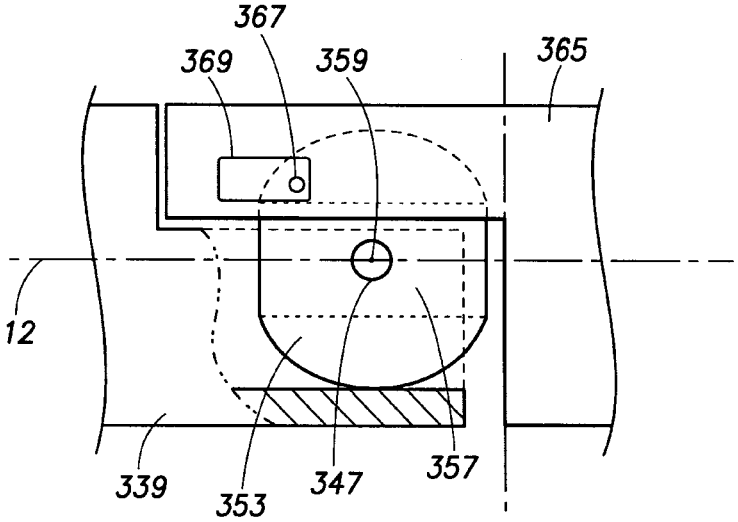
FIG. 13B is a partial cross section of the components depicted in FIG. 13A in an "actuated configuration" consistent with at least one embodiment of the present disclosure.
Figure 14:
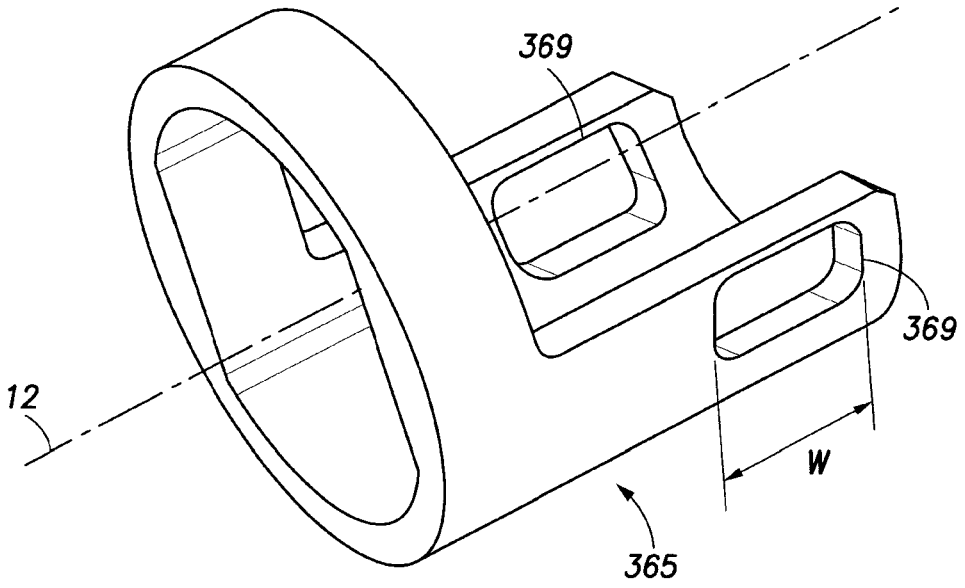
FIG. 14 is a perspective view of a rotation pin sleeve consistent with at least one embodiment of the present disclosure.

Rotatable ball 353 is actuated by rotation pin sleeve 365. Shift sleeve 339, rotatable ball 353, and rotation pin sleeve 365 are shown in detail in FIGS. 13A-13B. Rotation pin sleeve 365 is shown separately in FIG. 14. Ball seat 349 and pressure tube 363 are likewise not shown and shift sleeve 339 is in partial cross section to aid with understanding of functionality. FIG. 13A shows the run-in configuration and FIG. 13B shows the actuated configuration of the parts. Rotatable ball 353 is coupled to rotation pin sleeve 365 by rotation pin 367. Rotation pin 367 extends parallel to valve axle axis 14 (not shown) and is positioned eccentrically on the surface of rotatable ball 353. Rotation pin 367 fits into rotation window 369 formed in rotation pin sleeve 365.

In the run-in configuration of FIG. 13A, valve bore 357 is not aligned with central axis 12, thereby restricting flow to valve output bore 361 (not shown), defining a "closed" position. As shift sleeve 339 and rotatable ball 353 are forced axially downward (depicted here as a translation to the right), rotation pin 367 travels axially within rotation window 369. During the initial movement within a distance of ball seal retention length C, rotatable ball 353 remains in the closed position. Ball seal retention length C can be approximated by the following equation:

$$C=w-d_{rotation\ pin}$$

where w is the axial length of rotation window 369, and $d_{rotation\ pin}$ is the diameter of rotation pin 367.

Rotation pin 367 is positioned a selected distance from valve axle axis 14, defining a rotation pin eccentricity length D. Rotation pin 367 is positioned along a line extending 45 degrees from central axis 12. Eccentricity length D is selected such that rotatable ball 353 is rotated approximately 90° when shift sleeve 339 is moved stroke length A with a ball seal retention length C.

Once shift sleeve 339 and rotatable ball 353 have moved ball seal retention length C, rotation pin 367 contacts the wall of rotation window 369. As shift sleeve 339 continues to move, rotatable ball 353 is rotated about valve axle axis 14 by the resultant force applied by rotation pin sleeve 365 on rotation pin 367 through the wall of rotation window 369. As rotatable ball 353 rotates, valve bore 357 begins to open fluid communication between valve sub bore 315 and valve bore 357, and subsequently valve output bore 361. Ball seal retention length C is selected such that it is greater than packer cut-off length B in order to prevent fluid communication between valve sub bore 315 and valve bore 357 until after apertures 333 have seated within lower control housing 325. Once shift sleeve 339 and rotatable ball 353 have moved stroke length A, valve bore 357 is aligned with central axis 12, thereby allowing fluid continuous flow between valve sub bore 315 and valve output bore 361.

Likewise, as shift sleeve 339 and rotatable ball 353 are moved axially upward, rotation pin 367 contacts the other wall of rotation window 369. As shift sleeve 339 and rotatable ball 353 continue to move upward, the resultant force causes rotatable ball 353 to rotate back approximately 90°, thereby isolating valve sub bore 315 from valve output bore 361 and returning to its run-in configuration. Geometry of rotation window 369 is selected such that rotatable ball 353 remains at least partially open when apertures 333 are opened to annular space 327.

Referring back to FIG. 5, valve operating chamber 371 is defined by the inner wall of lower control housing 325, rotatable ball 353 and shift sleeve 339, and pressure tube 363 and rotation pin sleeve 365. As shift sleeve 339 and rotatable ball 353 are shifted into the actuated position, valve operating chamber 371 decreases in volume. Any trapped fluid is permitted to return to valve sub bore 315 from operating chamber 371 through grooves (not shown) in debris barrier 345.

Lower end of lower control housing 325 is coupled to the upper end of crossover housing 373. Crossover housing 373 may include at least one port formed in its wall to form a continuation of packer inflation port 329. Crossover housing 373 is a generally cylindrical tube extending downward along central axis 12. Crossover housing 373 is depicted as threadedly coupled to control housing 325. Pressure tube 363 is coupled within the upper bore of crossover housing 373. Continuing to FIG. 6, crossover housing 373 is coupled to upper packer sub 40.

Upper packer sub 40 is a generally cylindrical tube, including upper packer mandrel 401 having upper packer bore 403 fluidly connected to valve output bore 361. Upper packer sub 40 is configured to allow fluid to flow from packer inflation port 329 to the interior of upper packer 405. Upper packer sub 40 may include upper ring 407 which is threadedly connected to downwardly and inwardly tapered member 409, thereby compressively sealing the end of upper packer 405 against the interior of upper packer housing 411. Holes in upper ring 407 pass fluid from packer inflation port 329 to the interior of upper packer 405. Upper packer 405 may include upper packer inner layer 413 and upper packer outer layer 415, both depicted as elastomeric material, and an upper and lower metal packer shield 417, 419. Upper and lower metal packer shields 417, 419 may be configured to control the inflation of upper packer 405.

Figure 7:
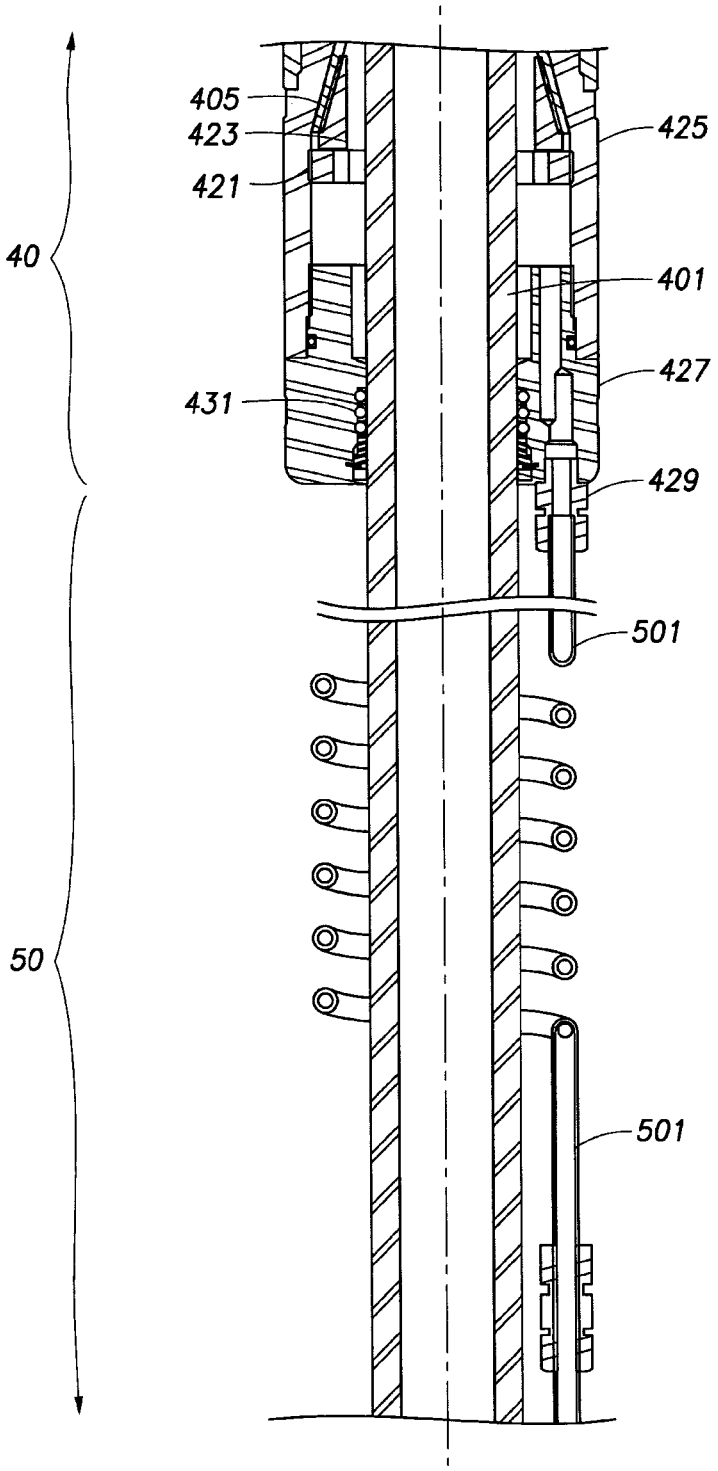
FIG. 7 is a continuation of the partial cross section of FIG. 6.

FIG. 7 depicts the lower end of upper packer sub 40, including lower ring 421 which is threadedly connected to upwardly and inwardly tapered member 423, compressing the end of upper packer 405 against the interior of lower packer housing 425. Holes in lower ring 421 allow fluid to pass from upper packer 405 to upper packer bottom housing 427, which may include upper packer hose connector 429. Upper packer hose connector 429 allows fluid to pass from upper packer bottom housing 427 through hose 501, which fluidly connects to lower packer sub 60. Upper packer bottom housing 427 may also include at least one seal 431 to isolate fluid in the wellbore from fluid used to inflate the packers.

Figure 8:
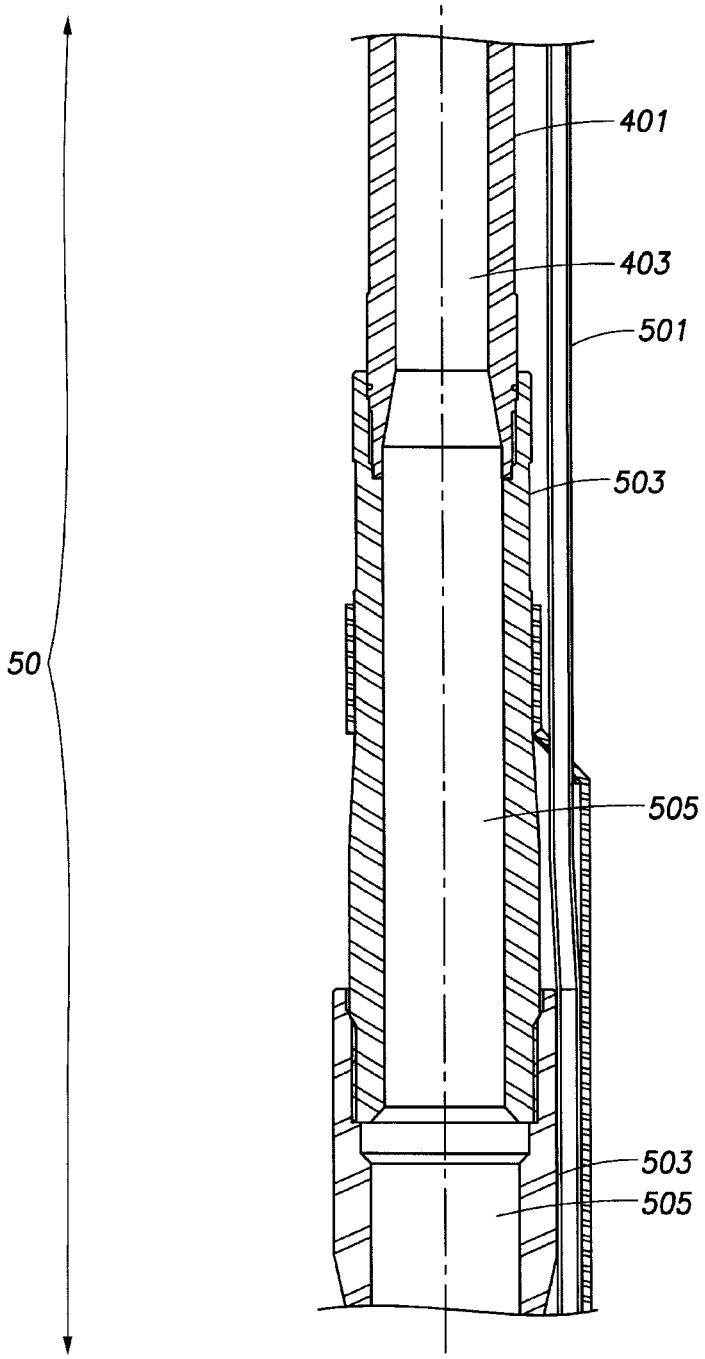
FIG. 8 is a continuation of the partial cross section of FIG. 7.
Figure 9:
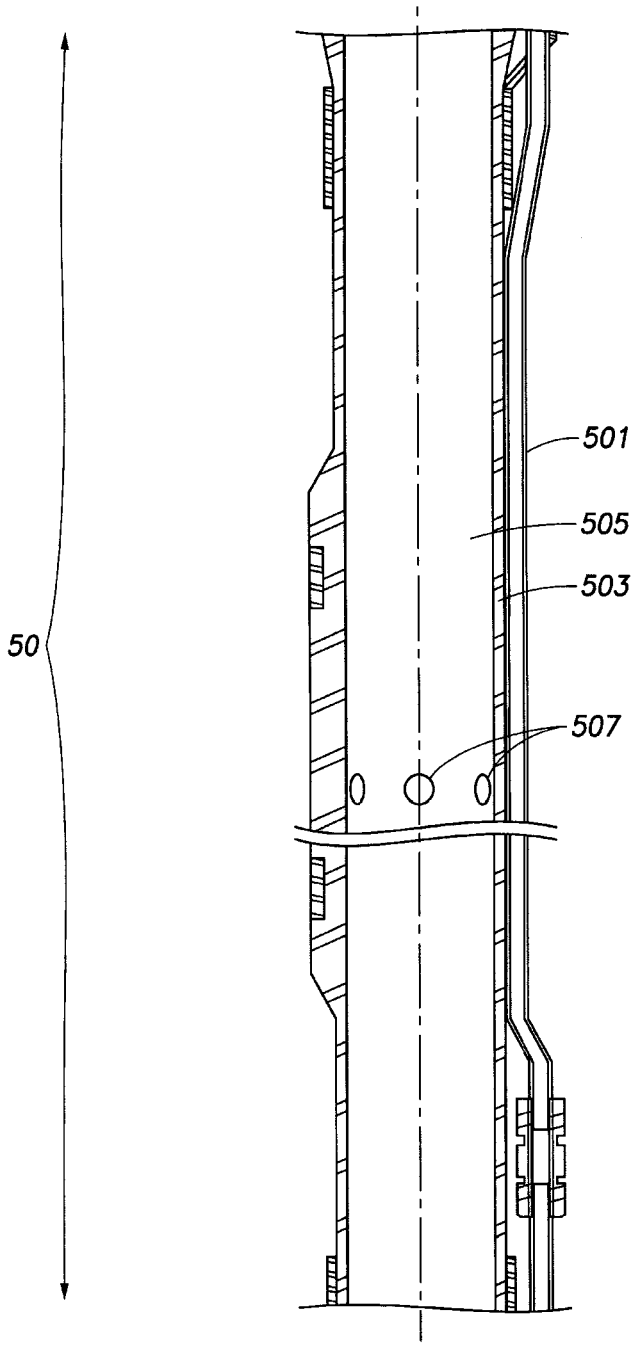
FIG. 9 is a continuation of the partial cross section of FIG. 8.
Figure 10:
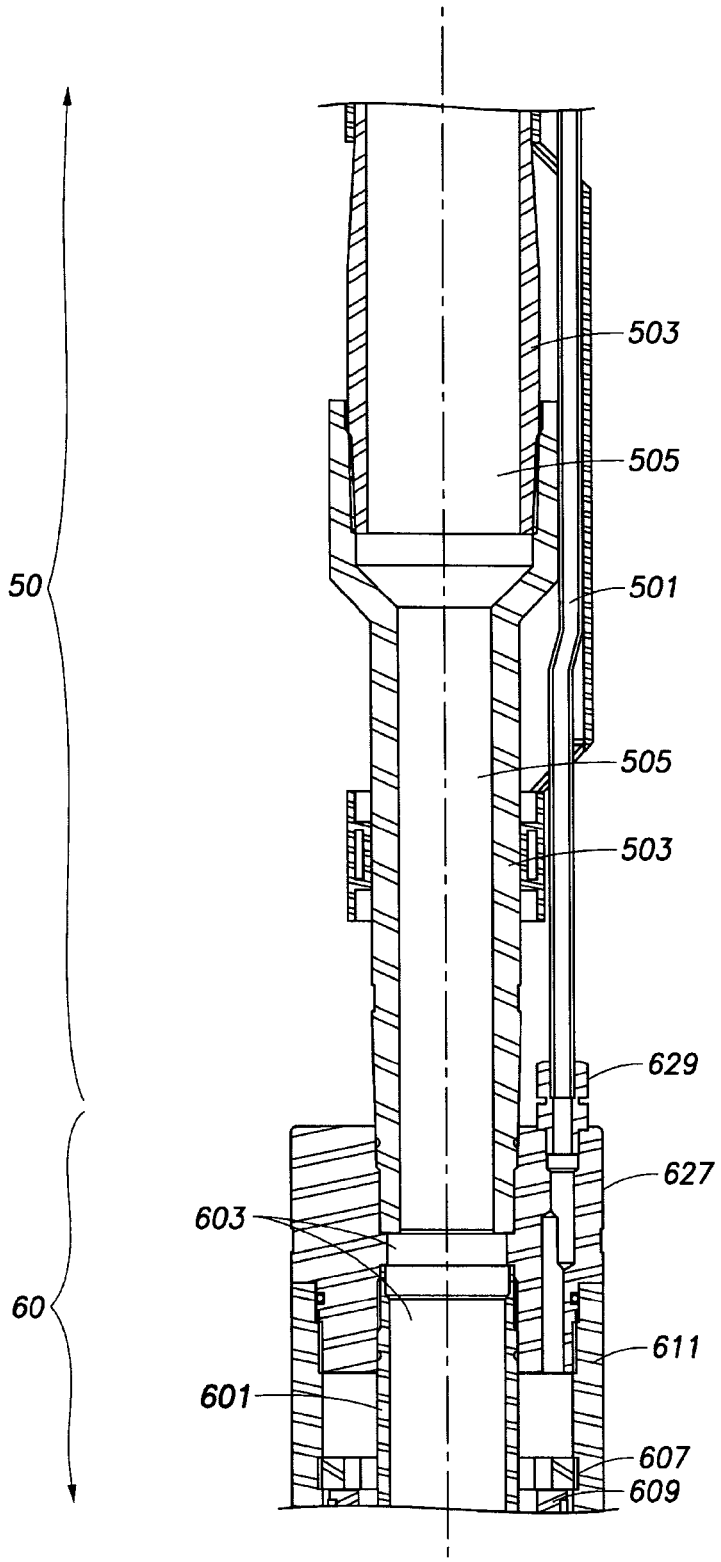
FIG. 10 is a continuation of the partial cross section of FIG. 9.

Continuing to FIGS. 8-10, upper packer mandrel 401 continues axially downward and couples to at least one fracing mandrel 503. Fracing mandrel 503 has fracing sub bore 505 fluidly connected to upper packer bore. Fracing mandrel 503 may include one or more fracing apertures 507 which connects fracing sub bore 505 with the wellbore surrounding fracing mandrel 503, thereby allowing for hydraulic fracturing of a surrounding formation (not shown). The exemplary embodiment shown by the figures may include multiple lengths of pipe to make up fracing mandrel 503. The displayed configuration of fracing mandrel 503, including, for example, number of pipes, length of pipe sections, overall length, and configuration of pipe, will be understood by one of ordinary skill in the art to be only an example, and any reconfiguration would not deviate from the scope of this disclosure. Likewise, the configuration of fracing apertures 507, including, for example, number, shape, and positioning of fracing apertures, will be understood by one of ordinary skill in the art to be only an example, and any reconfiguration would not deviate from the scope of this disclosure.

Hose 501 is shown continuing downward through the well bore, having various fittings and configurations to, for example, secure additional lengths of hose, couple hose 501 to fracing mandrel 503, allow strain relief, etc. One of ordinary skill in the art will readily understand that the configuration shown in the figures is meant only as an example, and any reconfiguration would not deviate from the scope of this disclosure.

Fracing mandrel 503 couples, at its lower end, to upper end of lower packer sub 60, here shown as threadedly connected to lower packer top housing 627. Lower packer top housing 627 may include lower packer bore 603 fluidly connected to fracing sub bore 505. Lower packer top housing 627 is coupled at its lower end to the upper end of lower packer mandrel 601, the bore of which fluidly connected to and forming an extension of lower packer bore 603.

Lower packer top housing 627 may also include lower packer hose connector 629 which is coupled to hose 501 and allows fluid to pass from hose 501 to lower packer sub 60, thereby connecting upper packer sub 40 to lower packer sub 60. Fluid from hose 501 can pass through at least one inflation port 631 to the interior of lower packer 605.

Figure 11:
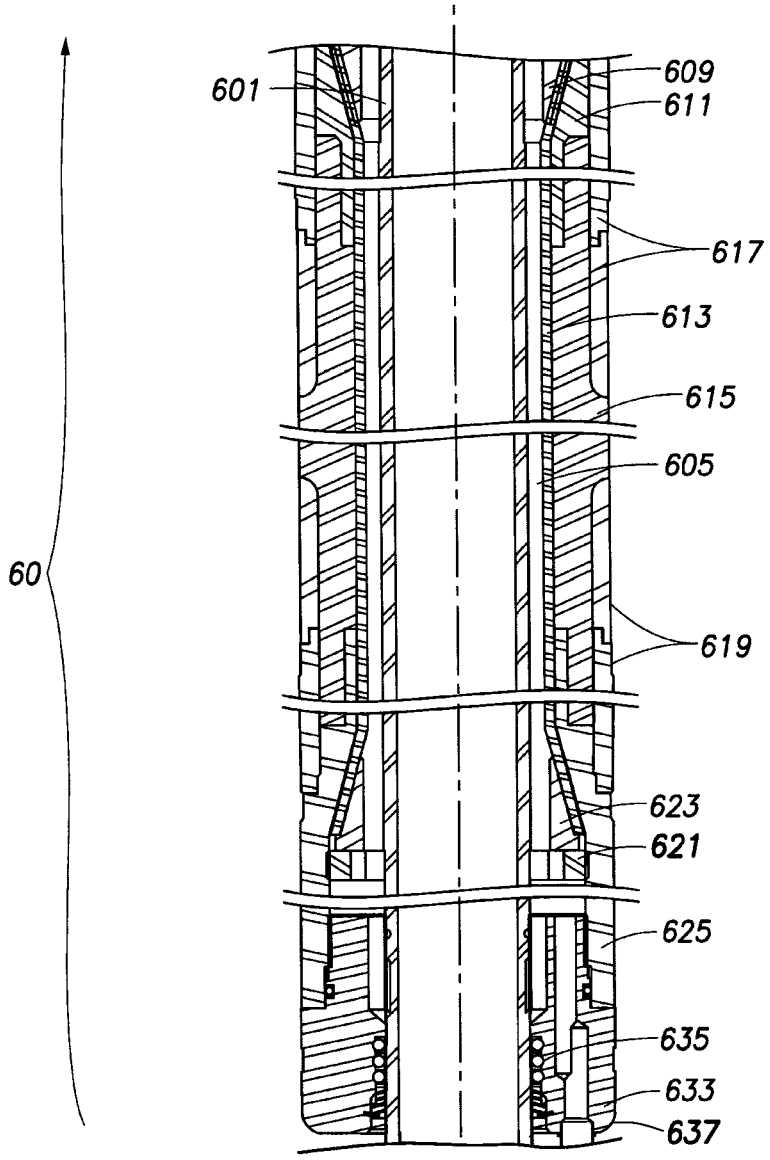
FIG. 11 is a continuation of the partial cross section of FIG. 10.
Figure 12:
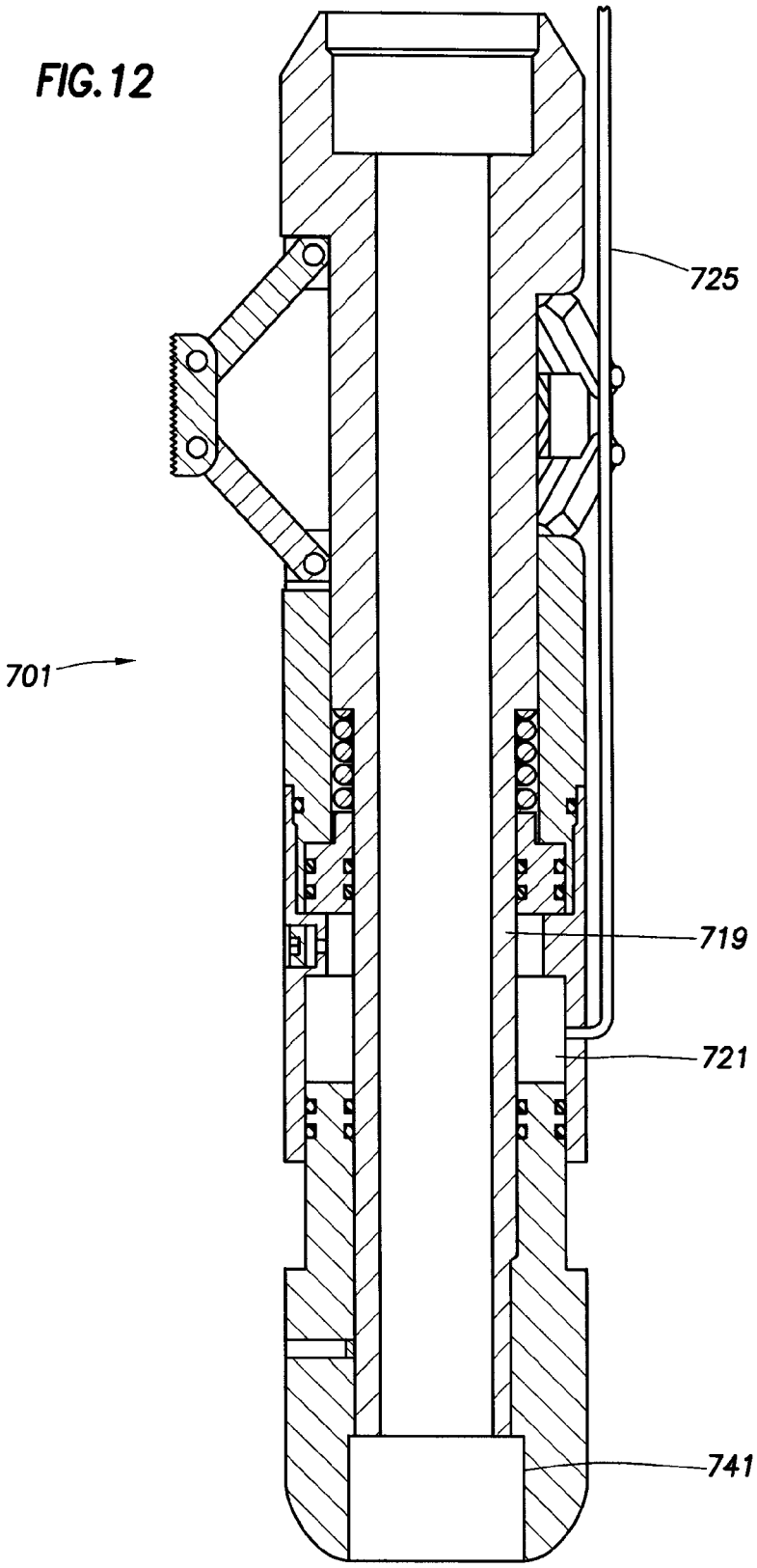
FIG. 12 is a continuation of the partial cross section of FIG. 11.

Referring to FIGS. 10, 11, lower packer sub 60 may include upper ring 607 which is threadedly connected to downwardly and inwardly tapered member 609, thereby compressively sealing the end of lower packer 605 against the interior of upper packer housing 611. Holes in upper ring 607 pass fluid from inflation port 631 to the interior of lower packer 605. Lower packer 605 may include lower packer inner layer 613 and lower packer outer layer 615, both depicted as elastomeric material, and at least one upper and lower metal packer shield 617, 619. Upper and lower metal packer shields 617, 619 may be configured to control the inflation of upper packer 605. The lower end of lower packer sub 60, may include lower ring 621 which is threadedly connected to upwardly and inwardly tapered member 623, compressing the end of lower packer 605 against the interior of lower packer housing 625. Here, lower packer sub 60 is shown to have a lower packer bottom housing 633 including at least one seal 635 to isolate fluid in the wellbore from fluid used to inflate the packers.

Lower end of lower packer mandrel 601 is coupled to hydraulic anchor 701. Hydraulic anchor 701 is positioned to be actuated by control hose 725 coupled to lower packer control hose connector 637. Control hose 725 is coupled to actuation cylinder 721. Thus, once valve sub 30 is actuated, upper packer sub 40, lower packer sub 60, and hydraulic anchor 701 are all actuated by the same fluid pressure. In some embodiments, hydraulic anchor 701 may provide anchoring between straddle packer assembly 10 and the surrounding wellbore or tubular to, for example, allow force applied by the tool string to press down against control tube 301. Additionally, hydraulic anchor 701 may include mandrel 719 which, in such an embodiment, may be a tubular member having no apertures. In some embodiments, hydraulic anchor 701 may include a lower connector 741 allowing, for example, the connection of a tubular member below hydraulic anchor 701.

Figure 16:
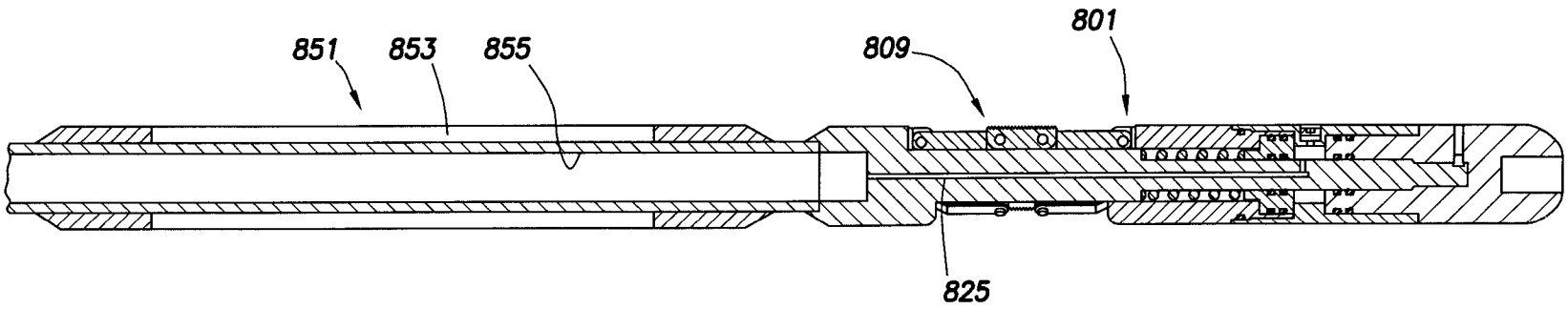
FIG. 16 is a partial cross section of a hydraulic anchor consistent with embodiments of the present disclosure.

In other embodiments, as depicted in FIG. 16, hydraulic anchor 801 may instead be used with a swellable packer 851. Swellable packer may include a swellable packer mandrel 855. Positioned about swellable packer mandrel 855 is swellable elastomeric body 853 which increases in volume in response to the absorption of a swelling fluid, generally an oil or water-based fluid. The composition of the swelling fluid needed to activate swellable packer elements 105 may be selected with consideration of the conditions of the wellbore. Once activated, the swelling fluid comes into contact with swellable elastomeric body 853 and is absorbed by the elastomeric material. In response to the absorption of swelling fluid, swellable elastomeric body increases in volume and eventually contacts the surrounding wellbore or tubular. Continued swelling of swellable elastomeric body 853 may form a seal between swellable packer mandrel 855 and the surrounding wellbore or tubular. The fluid seal may serve to prevent any high-pressure fluids which may be encountered during the life of the wellbore from escaping around swellable packer 851.

In operation, swellable packer 851 and hydraulic anchor 801 are positioned in the wellbore. As previously discussed, fluid pressure actuates hydraulic anchor 801, holding swellable packer 851 in position within the wellbore during the time it takes for swellable packer 851 to fully expand and create the seal. In some embodiments, a valve (not shown) may be positioned within mechanical anchor 801 to cause mechanical anchor 801 to permanently remain in the engaged position once pressure inside actuation port 825 is bled. In some embodiments, a mechanical retainer (not shown) may be positioned within actuation cylinder to retain mechanical anchor 801 in the engaged position with extendible arm 809 in the extended position once extended. One having ordinary skill in the art with the benefit of this disclosure will understand that any such mechanical retainer mechanism may be used, including without limitation, a spring-loaded pawl, ratchet system, etc. may be utilized without deviating from the scope of this disclosure. With mechanical anchor 801 retained in the open position, the tool string used to position swellable packer 851 within the wellbore may thus be removed, leaving swellable packer 851 within the wellbore while it expands and, for example, to seal against the wellbore.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions and alterations herein without departing from the spirit and scope of the present disclosure.

The invention claimed is:

1. A downhole tool for use within a wellbore, the downhole tool comprising:

a hydraulic anchor, the hydraulic anchor including:

a tool body, the tool body including a generally cylindrical mandrel, the tool body including a coupler positioned to allow the tool body to couple to a tubular member, the mandrel having an interior;

a stroking sleeve, the stroking sleeve being generally tubular, the stroking sleeve positioned to slide along the mandrel of the tool body;

an actuation cylinder, the actuation cylinder formed between the stroking sleeve and the tool body, the actuation cylinder fluidly coupled to the interior of the mandrel;

an extendible arm, the extendible arm including a grip plate, a first extension linkage, and a second extension linkage, the first extension linkage pivotably coupled between the tool body and the grip plate, and the second extension linkage pivotably coupled between the grip plate and the stroking sleeve;

an inflatable packer, the inflatable packer including:

a packer mandrel, the packer mandrel having an interior in fluid communication with the interior of the mandrel of the tool body;

a packer bladder, the packer bladder being generally tubular in shape and positioned about the packer mandrel; and a packer inflation port, the packer inflation port formed in the packer mandrel, the packer inflation port positioned to couple the interior of the packer mandrel with an annular space between the packer mandrel and the packer bladder.

2. The downhole tool of claim 1, further comprising:
a rupture disc positioned in fluid communication with the actuation cylinder and the wellbore, the rupture disc adapted to mechanically fail when fluid pressure within the actuation cylinder reaches a threshold pressure.

3. The downhole tool of claim 1, further comprising:
a spring positioned to bias the stroking sleeve to a run-in position, the run-in position defined as the position at which the extendible arm is fully retracted.

4. The downhole tool of claim 1, wherein the tool body further comprises a lower sub, the lower sub coupled to the mandrel.

5. The downhole tool of claim 1, further comprising:
a second inflatable packer, the second inflatable packer including:
a second packer mandrel, the second packer mandrel having an interior;
a second packer bladder, the second packer bladder being generally tubular in shape and positioned about the second packer mandrel;
a second packer inflation port, the packer inflation port formed in the packer mandrel, the second packer inflation port positioned to couple the interior of the second packer mandrel with a second annular space between the second packer mandrel and the second packer bladder; and
a perforated sub, the perforated sub including a perforated sub mandrel, the perforated sub mandrel including at least one selectively actuatable aperture positioned between the interior of the perforated sub mandrel and the wellbore, the perforated sub mandrel having a first and second end, the first end coupled to the first inflatable packer, and the second end coupled to the second inflatable packer.

6. The downhole tool of claim 1, wherein the actuation cylinder is fluidly coupled to the interior of the mandrel via a port formed in the mandrel.

7. The downhole tool of claim 1, further comprising a generally tubular three-way sub positioned between the tool body and the packer mandrel, the three-way sub including a port formed in a wall of the three-way sub positioned to fluidly couple an interior of the three-way sub to the actuation cylinder and the packer inflation port.

8. The downhole tool of claim 1, wherein the actuation cylinder is fluidly coupled to the interior of the mandrel via a control hose.

9. The downhole tool of claim 1, wherein the hydraulic anchor further comprises a valve positioned to retain the pressure within the actuation cylinder after fluid pressure is bled from the interior of the mandrel.

10. The downhole tool of claim 1, wherein the hydraulic anchor further comprises a mechanical retainer positioned to permanently retain the extendible arm in an extended position once the extendible arm is extended.

11. A downhole tool for use within a wellbore, the downhole tool comprising:
a hydraulic anchor, the hydraulic anchor including:
a tool body, the tool body including a generally cylindrical mandrel, the tool body including a coupler positioned to allow the tool body to couple to a tubular member, the mandrel having an interior;
a stroking sleeve, the stroking sleeve being generally tubular, the stroking sleeve positioned to slide along the mandrel of the tool body;
an actuation cylinder, the actuation cylinder formed between the stroking sleeve and the tool body, the actuation cylinder fluidly coupled to the interior of the mandrel;
an extendible arm, the extendible arm including a grip plate, a first extension linkage, and a second extension linkage, the first extension linkage pivotably coupled between the tool body and the grip plate, and the second extension linkage pivotably coupled between the grip plate and the stroking sleeve;
a swellable packer, the swellable packer including:
a packer mandrel, the packer mandrel having an interior in fluid communication with the interior of the mandrel of the tool body, the packer mandrel coupled to the tool body; and
an elastomeric swellable body, the elastomeric swellable body being generally tubular in shape and positioned about the packer mandrel.

12. The downhole tool of claim 11, further comprising:
a rupture disc positioned in fluid communication with the actuation cylinder and the wellbore, the rupture disc adapted to mechanically fail when fluid pressure within the actuation cylinder reaches a threshold pressure.

13. The downhole tool of claim 11, further comprising:
a spring positioned to bias the stroking sleeve to a run-in position, the run-in positioned defined as the position at which the extendible arm is fully retracted.

14. The downhole tool of claim 11, wherein the tool body further comprises a lower sub, the lower sub coupled to the mandrel.

15. The downhole tool of claim 11, wherein the actuation cylinder is fluidly coupled to the interior of the mandrel via a port formed in the mandrel.

16. The downhole tool of claim 11, wherein the hydraulic anchor further comprises a valve positioned to retain the pressure within the actuation cylinder after fluid pressure is bled from the interior of the mandrel.

17. The downhole tool of claim 11, wherein the hydraulic anchor further comprises a mechanical retainer positioned to permanently retain the extendible arm in an extended position once the extendible arm is extended.

18. A method comprising:
positioning a tool string within a wellbore, the tool string including:
a hydraulic anchor, the hydraulic anchor including:
a tool body, the tool body including a generally cylindrical mandrel, the tool body including a coupler positioned to allow the tool body to couple to a tubular member, the mandrel having an interior;
a stroking sleeve, the stroking sleeve being generally tubular, the stroking sleeve positioned to slide along the mandrel of the tool body;
an actuation cylinder, the actuation cylinder formed between the stroking sleeve and the tool body, the actuation cylinder fluidly coupled to the interior of the mandrel;
an extendible arm, the extendible arm including a grip plate, a first extension linkage, and a second extension linkage, the first extension linkage pivotably coupled between the tool body and the grip plate, and the second extension linkage pivotably coupled between the grip plate and the stroking sleeve;
a swellable packer, the swellable packer including:
a packer mandrel, the packer mandrel having an interior in fluid communication with the interior of the mandrel of the tool body, the packer mandrel coupled to the tool body;

an elastomeric swellable body, the elastomeric swellable body being generally tubular in shape and positioned about the packer mandrel;

applying fluid pressure to the actuation cylinder;

extending the extendible arm, the extendible arm contacting the surrounding wellbore; and exposing the elastomeric swellable body to a swelling fluid, the elastomeric swellable body increasing in volume to form a seal between the packer mandrel and the wellbore.

19. The method of claim 18, further comprising:

disconnecting the tool string from the swellable packer so that the swellable packer and hydraulic anchor remain in the wellbore;

removing the tool string from the wellbore.

20. A method comprising:

positioning a tool string within a wellbore, the tool string including:

a hydraulic anchor, the hydraulic anchor including:

a tool body, the tool body including a generally cylindrical mandrel, the tool body including a coupler positioned to allow the tool body to couple to a tubular member, the mandrel having an interior;

a stroking sleeve, the stroking sleeve being generally tubular, the stroking sleeve positioned to slide along the mandrel of the tool body;

an actuation cylinder, the actuation cylinder formed between the stroking sleeve and the tool body, the actuation cylinder fluidly coupled to the interior of the mandrel;

an extendible arm, the extendible arm including a grip plate, a first extension linkage, and a second extension linkage, the first extension linkage pivotably coupled between the tool body and the grip plate, and the second extension linkage pivotably coupled between the grip plate and the stroking sleeve; and an inflatable packer, the inflatable packer including:

a packer mandrel, the packer mandrel having an interior in fluid communication with the interior of the mandrel of the tool body;

a packer bladder, the packer bladder being generally tubular in shape and positioned about the packer mandrel; and a packer inflation port, the packer inflation port formed in the packer mandrel, the packer inflation port positioned to couple the interior of the packer mandrel with an annular space between the packer mandrel and the packer bladder;

applying fluid pressure to the actuation cylinder;

extending the extendible arm, the extendible arm contacting the surrounding wellbore;

applying fluid pressure to the packer inflation port; and inflating the inflatable packer.

21. A downhole tool on a tool string having a tool string bore positionable in a wellbore having a wellbore axis, the downhole tool comprising:

a first packer sub coupled to the tool string, the packer sub having a first inflatable element and a first packer inflation port;

a valve sub coupled to the tool string, the valve sub having:

a valve sub housing, the valve sub housing being generally tubular having at least one packer supply port in fluid communication with the packer inflation port;

a control tube, the control tube being generally tubular and aligned with the valve sub housing and having an upper and lower end, the upper end coupled to the tool string, and the lower end positioned within the bore of the valve sub housing, the control tube having a bore and at least one aperture through its side wall, the control tube having an open position in which the aperture provides fluid communication between the bore of the control tube and the packer supply port, and a closed position in which the apertures are covered by the inner wall of the valve sub housing and the bore of the control tube, the control tube bore being in fluid communication with the tool string bore;

a shift sleeve coupled to the lower end of the control tube having a hole adapted to accept an axle pin;

a rotatable ball adapted to rotate about the axle pin, the rotatable ball having at least one flow path through its body, the rotatable ball having an open position and a closed position selected by the upward or downward movement of the tool string, the open and closed positions of the rotatable ball being in opposition to the open and closed position of the control tube, thereby allowing or preventing fluid flow through the at least one flow path from the tool string bore and the bore of the control tube, the rotatable ball having a rotation pin extending from its outer surface; and a rotation pin sleeve coupled to the rotation pin adapted to rotate the ball from the closed position to the open position in response to a movement of the ball toward or away from the rotation pin sleeve;

a hydraulic anchor, the hydraulic anchor including:

a tool body, the tool body including a generally cylindrical mandrel, the tool body including a coupler positioned to allow the tool body to couple to a tubular member, the mandrel having an interior in fluid communication with the interior of the mandrel of the tool body;

a stroking sleeve, the stroking sleeve being generally tubular, the stroking sleeve positioned to slide along the mandrel of the tool body;

an actuation cylinder, the actuation cylinder formed between the stroking sleeve and the tool body, the actuation cylinder fluidly coupled to the interior of the mandrel; and an extendible arm, the extendible arm including a grip plate, a first extension linkage, and a second extension linkage, the first extension linkage pivotably coupled between the tool body and the grip plate, and the second extension linkage pivotably coupled between the grip plate and the stroking sleeve.

* * * * *